US012195914B2

(12) United States Patent
Tyler

(10) Patent No.: US 12,195,914 B2
(45) Date of Patent: Jan. 14, 2025

(54) TUFTED CARPET COMPRISING A SECONDARY CARPET BACKING

(71) Applicant: LOW & BONAR INC., Enka, NC (US)

(72) Inventor: Rob Tyler, Canton, NC (US)

(73) Assignee: FREUDENBERG PERFORMANCE MATERIALS LP, Plymouth, MI (US)

( * ) Notice: Subject to any disclaimer, the term of this patent is extended or adjusted under 35 U.S.C. 154(b) by 6 days.

(21) Appl. No.: 17/612,517

(22) PCT Filed: May 20, 2020

(86) PCT No.: PCT/IB2020/054756

§ 371 (c)(1),
(2) Date: Nov. 18, 2021

(87) PCT Pub. No.: WO2020/234783

PCT Pub. Date: Nov. 26, 2020

(65) Prior Publication Data

US 2022/0205173 A1 Jun. 30, 2022

(30) Foreign Application Priority Data

May 22, 2019 (EP) ..... 19175833

(51) Int. Cl.
*D06N 7/00* (2006.01)
*D05C 17/02* (2006.01)

(52) U.S. Cl.
CPC ..... *D06N 7/0081* (2013.01); *D05C 17/02* (2013.01); *D06N 7/0068* (2013.01); *D06N 7/0071* (2013.01); *D06N 2209/121* (2013.01); *D06N 2209/123* (2013.01); *D06N 2211/066* (2013.01); *D06N 2213/06* (2013.01); *D10B 2503/041* (2013.01); *Y10T 428/23979* (2015.04)

(58) Field of Classification Search
CPC .. D06N 7/0081; D06N 7/0068; D06N 7/0071; D06N 2209/121; D06N 2209/123; D06N 2211/066; D06N 2213/06; D10B 2503/041; D05C 17/02; Y10T 428/23979
See application file for complete search history.

(56) References Cited

U.S. PATENT DOCUMENTS 4,140,071 A * 2/1979 Gee ..... D05C 17/02 428/95
4,305,986 A * 12/1981 Hartmann ..... D04H 3/12 428/95
4,426,415 A * 1/1984 Avery ..... D06N 7/0068 428/17
4,556,602 A * 12/1985 Williams ..... D05C 17/023 428/95
4,702,950 A * 10/1987 Slosberg ..... B32B 7/12 156/289
5,030,497 A * 7/1991 Claessen ..... B32B 5/26 428/95
5,204,155 A * 4/1993 Bell ..... B32B 7/12 156/60
5,470,648 A * 11/1995 Pearlman ..... B32B 5/06 442/26
5,714,224 A * 2/1998 Gerry ..... D06N 7/0076 428/95
6,060,145 A 5/2000 Smith et al.
2002/0160144 A1* 10/2002 Higgins ..... B32B 5/18 428/95
2003/0232171 A1* 12/2003 Keith ..... B32B 5/26 428/95
2004/0091664 A1* 5/2004 Gardner ..... B32B 5/26 428/95
2004/0134048 A1* 7/2004 Hartgrove ..... D04H 1/492 28/104
2004/0142142 A1 7/2004 Gardner et al.
2005/0053760 A1* 3/2005 Fowler ..... D06N 7/0081 428/95
2005/0287334 A1* 12/2005 Wright ..... D06N 7/0081 428/95
2007/0275207 A1* 11/2007 Higgins ..... D05C 17/023 428/95
2009/0110869 A1* 4/2009 Streeton ..... D06N 7/0071 428/95
2011/0292641 A1* 12/2011 Van Herpen ..... F21V 23/0442 362/153
2012/0244310 A1* 9/2012 Visscher ..... D04H 11/08 428/95
2020/0385922 A1* 12/2020 Hausman ..... B32B 5/08
2022/0136169 A1* 5/2022 Himstedt ..... D06N 7/0081 428/95

FOREIGN PATENT DOCUMENTS

GB 1 409 068 A 10/1975
JP H10-155633 A 6/1998
JP 2000-333816 A 12/2000
JP 2005-273272 A 10/2005
JP 2007-313312 A 12/2007
WO 03/033801 A2 4/2003
WO 2005/103358 A2 11/2005
WO 2006/093861 A2 9/2006
WO 2016/000869 A1 1/2016

OTHER PUBLICATIONS

Jul. 13, 2020 Search Report issued in International Patent Application No. PCT/IB2020/054756.

* cited by examiner

*Primary Examiner* — Cheryl Juska
(74) *Attorney, Agent, or Firm* — Oliff PLC

(57) ABSTRACT

A tufted carpet including a tufted primary carpet backing, pile yarns tufted into the primary carpet backing, a secondary carpet backing adjoining to the primary carpet backing on the side of the primary carpet backing which exhibits backstitches and optionally a precoat and/or a polymer coat, wherein the secondary carpet backing including at least a reinforcement layer of fibers and the secondary carpet backing has an air permeability of at least 1000 $l/m^2 \cdot s$, measured according to ISO 9237:1995.

14 Claims, No Drawings

TUFTED CARPET COMPRISING A SECONDARY CARPET BACKING

The application pertains to a tufted carpet comprising a secondary carpet backing and a method for producing such a tufted carpet comprising the secondary carpet backing.

In traditional carpet the productions there are many layers of different material behind the visible pile yarns. The construction behind the pile yarns comprises a primary carpet backing in which the pile yarns are tufted, and the primary carpet backing comprises a precoat to fixate the pile yarns. Below the tufted and precoated primary backing, a traditional carpet the comprises a layer of polymer, a reinforcement layer, a further layer of polymer and optionally a secondary carpet backing.

This reinforcement layer can be e.g. a fiber glass nonwoven or a scrim, and is responsible for reinforcement in a direction in the plane (x- and y-dimension) of the carpet tile. To transfer occurring forces applied in x- and/or y-direction of the carpet tile to the reinforcement layer, layers of polymer coating are required between the primary carpet backing and the reinforcement layer, and between the secondary carpet backing and the reinforcement layer.

These layers of polymer coating are expensive and carpet tile producers seek to minimize the mass of these two layers of polymer coating, but, a minimum quantity of polymer is required as it is substantial for an adequate bonding between the reinforcement layer and the primary carpet backing and/or between the reinforcement layer and the secondary carpet backing.

In some carpet tiles the reinforcement layer was moved from between the two layers of polymer directly onto the secondary carpet backing, so that it is possible to reduce the two layers of expensive polymer coating to only one layer, and to reduce the total mass of polymer in the carpet tile.

GB 1,409,068 discloses a method for providing a secondary backing to a tufted primary backing. Thereby, the reinforcement of the secondary backing is provided by longitudinal yarns being integral in the knitted structure, which are introduced during and as part of the knitting process.

The documents WO 2006/093861 A2, U.S. Pat. No. 6,060,145 and US 2004/0142142 disclose secondary carpet backings which have a high air permeability but due to the use of flat yarns/ribbons in the flat weave, a physical barrier is established in the secondary carpet backing, wherein a filler/binder mixture is prevented from bleeding through to the ground.

However, although it is possible to reduce the number layers of polymer coating by moving the reinforcement layer onto the secondary carpet backing, drawbacks occur like that additional adhesives have to be used to adhere the reinforcement layer onto the secondary carpet backing, and without being bound to theory it is believed that the moving of the reinforcement layer onto the secondary carpet backing has negative consequences for flatness stability (perpendicular to the plane of a carpet tile, z-dimension) like dishing or doming of the carpet tile.

Additionally, if a layer of polymer coating has a high affinity to the primary carpet backing, the polymer coating can be visible on the carpet face, which is known as latex bleeding.

The object of the present application is to provide a tufted carpet comprising a secondary carpet backing and a method for producing such a tufted carpet comprising the secondary carpet backing, which prevents or at least reduces the aforementioned drawbacks.

The object is reached by a tufted carpet comprising a tufted primary carpet backing, pile yarns tufted into the primary carpet backing, a secondary carpet backing adjoining to the primary carpet backing on the side of the primary carpet backing which exhibits backstitches and optionally a precoat and/or a polymer coat, wherein the secondary carpet backing comprises at least a reinforcement layer of fibers and the secondary carpet backing has an air permeability of at least $1000 l/m^2 \cdot s$, measured according to ISO 9237:1995.

For clarity reasons, the measuring of the air permeability according to ISO 9237:1995 is performed at a pressure difference of 200 Pa and a sample having a sample size of 20 $cm^2$.

The fact that the secondary carpet backing comprises a reinforcement layer of fibers improves the flatness stability perpendicular to the plane of a carpet tile (z-dimension), like dishing or doming of the carpet tile. The fact that the secondary carpet backing has a minimum air permeability improves penetration of the precoat and/or polymer coat applied to the tufted carpet so that the precoat can also penetrate the secondary carpet backing.

Without being bound to theory, it is believed that by adding a precoat and/or polymer coat to the tufted carpet comprising the primary carpet backing and the secondary carpet backing possible forces can be transmitted into the reinforcement layer of the secondary carpet backing through the precoat and/or the polymer coat.

Further, by the direct arrangement of the secondary carpet backing at the primary carpet backing, it is believed that additional precoats and/or polymer coating can be saved.

For clarity reasons, in the following are clarifications for some terms and phrases which are used during the application.

The term "composite" is to be understood as a material made from two or more constituent materials with significantly different physical or chemical properties that, when combined, produce a material with characteristics different from the individual components.

The phrase "substantially parallel" means that fibers of e.g. a unidirectional layer are spaced apart from each other so that the fibers do not contact adjacent fibers of the fibers of the unidirectional layer of fibers.

The terms "spunbonded" and "spun-laid" means the production of a nonwoven layer of fibers, wherein the fibers are extruded from a spinneret and subsequently laid down on a conveyor belt as a web of filaments and subsequently bonding the web to form a nonwoven layer of fibers, or by a two-step process wherein filaments are spun, drawn using e.g. drawing godets or air jets and wound on bobbins, preferably in the form of multifilament yarns, followed by the steps of unwinding the multifilament yarns and laying the filaments down on a conveyor belt as a web of filaments and bonding the web to form a nonwoven layer of fibers.

Within the scope of the present application it is understood that the term "fibers" refers to both staple fibers and filaments. Staple fibers are fibers which have a specified, relatively short length in the range of 2 to 200 mm. Filaments are fibers having a length of more than 200 mm. In an embodiment, the filaments have a length of more than 500 mm. In an embodiment, the filaments have a length of more than 1000 mm. Filaments may even be virtually endless, e.g. when formed by continuous extrusion and spinning of a filament through a spinning hole in a spinneret.

The term "carpet face" has to be understood as the side of a carpet which is visible when a carpet is laid on a ground.

In the case the carpet is laid on a ground, the side which is not visible is the side which exhibits backstitches of the tufting.

The tufted carpet comprises a tufted primary carpet backing, a secondary carpet backing and optionally a precoat and/or polymer coating. The secondary carpet backing is located adjacent to the primary carpet backing on the side of the primary carpet backing which exhibits backstitches and the precoat or polymer coat can be added to the secondary carpet backing and/or primary carpet backing.

The secondary carpet backing has an air permeability of at least 1000l/m$^2$·s measured according to ISO 9237:1995. Without being bound to theory, it is believed that due to the air permeability an optional precoat and/or a polymer coat is able to migrate from the backstage of the secondary carpet backing through the secondary carpet backing into the primary carpet backing.

In an embodiment, the air permeability of a secondary carpet backing is at least 3000l/m$^2$·s. In an embodiment, the air permeability of a secondary carpet backing is at least 5000l/m$^2$·s. In an embodiment, the air permeability of a secondary carpet backing is at least 7000l/m$^2$·s. In an embodiment, the air permeability of a secondary carpet backing is at least 9000l/m$^2$·s. In an embodiment, the air permeability of a secondary carpet backing is at least 10500l/m$^2$·s. In an embodiment, the air permeability of a secondary carpet backing is at least 12000 l/m$^2$·s. In all cases measured according to ISO 9237:1995.

In an embodiment, the secondary carpet backing is able to be impregnated by the precoat and/or the polymer coat. Thereby, the term "impregnated" has to be understood that the secondary backing is able to be saturated with the precoat and/or polymer coat such that no or negligible voids are present in the secondary backing after impregnation. In an embodiment, negligible voids comprise less than 5 vol.-% of the volume of the impregnated secondary backing. In an embodiment, negligible voids comprise less than 4 vol.-% of the volume of the impregnated secondary backing. In an embodiment, negligible voids comprise less than 3 vol.-% of the volume of the impregnated secondary backing. In an embodiment, negligible voids comprise less than 1 vol.-% of the volume of the impregnated secondary backing.

A plastisol according to the present application is a suspension of polymer particles, e.g. of PVC, in a liquid plasticizer. Upon heating, the particles dissolve in the plasticizer and form a gel of high viscosity. It is known to the person skilled in the art that a plastisol tends to sit on top of a fabric rather than impregnating into the fibers. Therefore, textile materials for proper impregnation by a plastisol have to be selected carefully.

In an embodiment, the plasticizer comprises phthalate esters such as DEHP, DINP and DIDP. In an embodiment, the plasticizer comprises aliphatic dibasic acid esters such as glutarates, adipates, azelates or sebacates. In an embodiment, the plasticizer comprises benzoate esters. In an embodiment, the plasticizer comprises phthalate esters such as DEHP, DINP and DIDP. In an embodiment, the plasticizer comprises trimellitate esters of alcohols with eight, nine or ten carbon atoms. In an embodiment, the plasticizer comprises polyesters. In an embodiment, the plasticizer comprises citric acid esters. In an embodiment, the plasticizer is bio-based and comprises epoxidized soy bean oil (ESBO), epoxidized linseed oil (ELO), castor oil, palm oil, other vegetable oils, starches or sugars. In an embodiment the plasticizer comprises chlorinated paraffins. In an embodiment the plasticizer comprises alkyl sulfonic esters. The plasticizer may comprise any mixture of the mentioned compounds.

In an embodiment, the plastisol comprises a heat stabilizer based on metal salts such as calcium stearate.

Apart from a plastisol also other organic containing binders or adhesives may be used. Possible organic binders are latices or hot-melt glues.

The openness of the primary carpet backing allows for use of adhesives with an increased solid content compared to the prior art. In an embodiment with a solid content of 5 wt. % may be used. In an embodiment with a solid content of 30 wt. % may be used. In an embodiment with a solid content of 40 wt. % may be used. In an embodiment with a solid content of 50 wt. % may be used. In an embodiment with a solid content of 60 wt. % may be used. In an embodiment with a solid content of 70 wt. % may be used. In an embodiment with a solid content of 80 wt. % may be used. In an embodiment with a solid content of 90 wt. % may be used. In an embodiment with a solid content of more than 90 wt. % may be used.

In an embodiment, the reinforcement layer comprised in the secondary carpet backing can be a nonwoven fabric, a woven fabric, a woven scrim, a laid scrim, or an unidirectional layer of fibers.

In an embodiment, the fibers of the unidirectional layer of fibers which have huge length in view of width and height (e.g. filaments) are spaced apart from each other at a constant distance over the entire length of the unidirectional layer of fibers.

As it is well known to the person skilled in the art, a scrim, no matter if laid or woven, is an open lattice structure composed of at least two sets of parallel threads, wherein the first group of parallel threads is oriented at an angle, generally at a 90° angle, to the second group of parallel threads. The first group of parallel threads may be connected to the second group of parallel threads by chemical bonding and/or the first group of parallel threads may be interwoven with the second group of parallel threads to form a woven scrim. In an embodiment, the openings in the scrim have at least one dimension in the plane of the carrier material being at least 1 mm. In an embodiment, the openings in the scrim have at least one dimension in the plane of the carrier material being at least 2 mm. In an embodiment, the openings in the scrim have at least one dimension in the plane of the carrier material being at least 5 mm. In an embodiment, the openings in the scrim have two dimensions in the plane of the carrier material being at least 1 mm. In an embodiment, the openings in the scrim have two dimensions in the plane of the carrier material being at least 2 mm. In an embodiment, the openings in the scrim have two dimensions in the plane of the carrier material being at least 5 mm.

The fibers of the reinforcement layer of the secondary carpet backing can be composed of any suitable material which is able to reinforce.

There are a few classes of material available: e.g. high modulus materials, low shrinkage materials and also materials which are resistant to compression.

All classes of materials have their own advantageous properties, for the stability of a secondary carpet backing. High modulus materials add the advantageous property that the secondary carpet backing has an increased stability against elongation. Low shrinkage materials add the advantageous property that the secondary carpet backing has an increased stability against shrinkage, e.g. if temperatures above ambient temperatures impacts the primary carpet backing. Moreover, materials, which are resistant to compression, increase the stability of the secondary carpet backing against compression, e.g. stiffness, if e.g. compression forces are impacting the secondary carpet backing.

In an embodiment, the reinforcement layer of the secondary carpet backing comprises high modulus fibers composed of a material, preferably selected from a group comprising glass, carbon, basalt, stone wool, high modulus low shrinkage (HMLS) polyester, mineral material, aramid such as para aramid (PPTA) and meta aramid (MPTA), and ultra high molecular weight polyethylene (UHMWPE).

In an embodiment, the fibers of the reinforcement layer of fibers have a tensile modulus of at least 25 GPa. In an embodiment, the fibers of the reinforcement layer of fibers have a tensile modulus of at least 40 GPa. In an embodiment, the fibers of the reinforcement layer of fibers have a tensile modulus of at least 50 GPa. In an embodiment, the fibers of the reinforcement layer of fibers have a tensile modulus of at least 75 GPa.

In an embodiment, the fibers of the reinforcement layer have a linear density of at most 50 tex. In an embodiment, the fibers of the reinforcement layer have a linear density of at most 40 tex. In an embodiment, the fibers of the reinforcement layer have a linear density of at most 30 tex. In an embodiment, the fibers of the reinforcement layer have a linear density of at most 28 tex. In an embodiment, the fibers of the reinforcement layer have a linear density of at most 20 tex. In an embodiment, the fibers of the reinforcement layer have a linear density of at most 15 tex.

Without being bound to theory, it is believed that the higher the linear density of the fibers of the reinforcement layer is the higher the bending stiffness of the reinforcement layer is. Hence, the upper limit of the linear density of the fibers of the reinforcement layer is practically endless but limited by the technical limitations of the production machines.

Apart from scrims, the secondary carpet backing of the tufted carpet may be free of woven fabrics.

The secondary carpet backing of the tufted carpet may comprise at least one nonwoven layer.

The secondary carpet backing of the tufted carpet can also comprise two nonwoven layers of fibers, wherein the reinforcement layer can be located between the two nonwoven layers of fibers.

In an embodiment, at least one, several or all of the nonwoven layers of fibers of the secondary carpet backing of the tufted carpet has an average weight of at most 50 g/m$^2$. In an embodiment, at least one, several or all of the nonwoven layers of fibers of the secondary carpet backing of the tufted carpet has an average weight of at most 30 g/m$^2$. In an embodiment, at least one, several or all of the nonwoven layers of fibers of the secondary carpet backing of the tufted carpet has an average weight of at most 25 g/m$^2$. In an embodiment, at least one, several or all of the nonwoven layers of fibers of the secondary carpet backing of the tufted carpet has an average weight of at most 20 g/m$^2$. In an embodiment, at least one, several or all of the nonwoven layers of fibers of the secondary carpet backing of the tufted carpet has an average weight of at most 15 g/m$^2$. In an embodiment, at least one, several or all of the nonwoven layers of fibers of the secondary carpet backing of the tufted carpet has an average weight of at most 10 g/m$^2$. In an embodiment, at least one, several or all of the nonwoven layers of fibers of the secondary carpet backing of the tufted carpet has an average weight of at most 7 g/m$^2$. The average weight being measured according to DIN/ISO EN29073-1 in all cases.

In an embodiment, the fibers of at least one, several or all of the nonwoven layers of fibers of the secondary carpet backing of the tufted carpet have an average diameter of at least 30 μm. In an embodiment, the fibers of at least one, several or all of the nonwoven layers of fibers of the secondary carpet backing of the tufted carpet have an average diameter of at least 35 μm. In an embodiment, the fibers of at least one, several or all of the nonwoven layers of fibers of the secondary carpet backing of the tufted carpet have an average diameter of at least 40 μm. In an embodiment, the fibers of at least one, several or all of the nonwoven layers of fibers of the secondary carpet backing of the tufted carpet have an average diameter of at least 50 μm. In an embodiment, the fibers of at least one, several or all of the nonwoven layers of fibers of the secondary carpet backing of the tufted carpet have an average diameter of at least 60 μm.

Due to the relatively high average diameter of the fibers of at least one, several or all of the nonwoven layers of fibers, a reduced surface coverage of each of the nonwoven layer of fibers can occur, a higher air permeability can be provided.

In an embodiment, the fibers of at least one, several or all of the nonwoven layers of fibers of the secondary carpet backing of the tufted carpet have an average weight of at most 30 g/m$^2$, preferably of at most 25 g/m$^2$, more preferably of at most 20 g/m$^2$, even more preferably of at most 15 g/m$^2$, and most preferably of at most 10 g/m$^2$, and the fibers of each of the nonwoven layers of fibers of the secondary carpet backing of the tufted carpet have an average diameter of at least 30 μm, preferably of at least 35 μm, more preferably of at least 40 μm and even more preferably of at least 50 μm and most preferably of at least 60 μm.

Without being bound to theory it is believed that the combination of a relatively low average weight of at least one, several or all of the nonwoven layers of fibers of the secondary carpet backing and a relatively high average diameter of the fibers of at least one, several or all of the nonwoven layers of fibers of the secondary carpet backing will lead to a reduced surface coverage of the at least one, several or all of the nonwoven layers of fibers of the secondary carpet backing, a higher air permeability can be provided.

In an embodiment, the fibers of at least one, several or all of the nonwoven layers of fibers of the secondary carpet backing comprise at least one thermoplastic polymeric material. In an embodiment, the thermoplastic polymeric material is selected from a group consisting of polyolefins such as polyethylene (PE) and polypropylene (PP), polyesters such as polyethylene terephthalate (PET), polybutylene terephthalate (PBT), polyethylene naphthalate (PEN), polyetylene-1,2-furandicaboxylate (PEF), and poly lactic acid (PLA), polyamides such as polyamide 6 (PA6), polyamide 6,6 (PA6,6), and copolymers and blends thereof.

In an embodiment, one, several or all of the nonwoven layers of fibers comprise more than one type of fibers with each type comprising different thermoplastic polymeric materials. In an embodiment, one, several or all of the nonwoven layers of fibers comprise fibers wherein different domains of the single fibers comprise different thermoplastic polymeric materials. In an embodiment, the fibers comprise a core which is made of a first polymeric material and a sheath which is made of a second polymeric material.

In an embodiment, the fibers of the at least one, several or all nonwoven layers of fibers of the secondary carpet backing comprises at least 50 wt.-% of a thermoplastic material. In an embodiment, the fibers of the nonwoven layer of fibers of the secondary carpet backing comprises at least 75 wt.-% of a thermoplastic material. In an embodiment, the fibers of the nonwoven layer of fibers of the secondary carpet backing comprises at least 85 wt.-% of a thermoplastic material. In an embodiment, the fibers of the nonwoven layer of fibers of the secondary carpet backing comprises at least 95 wt.-% of a thermoplastic material. In an embodiment, the fibers of the nonwoven layer of fibers of the secondary carpet backing comprises at least 97 wt.-% of a thermoplastic material.

Thereby, the thermoplastic polymeric material can comprise additives such as flame retardants, coloring agents, fillers, fungicides, and/or anti-bacterial agents.

In an embodiment, at least one, several or all of the nonwoven layers of fibers comprised in the secondary backing comprise mono component fibers, two types of mono-component fibers and/or bicomponent fibers.

In an embodiment, at least one, several or all of the nonwoven layers of fibers of the secondary carpet backing can be made by any suitable process, such as a spun-laid process, air-laid process, wet-laid process, melt-blown process, or a carding process.

In an embodiment, at least one, several or all of the nonwoven layers of fibers of the secondary carpet backing are made by a spun-laid process, wherein the fibers are made from a thermoplastic polymeric material. In the spun-laid process, bonding of the fibers each of the nonwoven layer of fibers can be conducted by any suitable process including chemical bonding hydro entanglement, needling, ultrasonic bonding, calendaring, and other thermal bonding method e.g. hot air bonding.

In an embodiment, at least one, several or all of the nonwoven layers of fibers of the secondary carpet backing comprises two types of mono component fibers, which comprise two chemically different thermoplastic polymeric materials, which differ in melting temperature by at least of 10° C. In an embodiment, the two chemically different thermoplastic polymeric materials, which differ in melting temperature by at least of 20° C. In an embodiment, the two chemically different thermoplastic polymeric materials, which differ in melting temperature by at least of 30° C. In an embodiment, the two chemically different thermoplastic polymeric materials, which differ in melting temperature by at least of 50° C. The melting temperature of a thermoplastic polymeric material is determined by Differential Scanning calorimetry (DSC) according to ISO 11357-3.

In an embodiment, the fibers of at least one, several or all of the nonwoven layers of fibers of the secondary carpet backing are bicomponent fibers of the concentric, eccentric core/sheath model, side-by-side model, segmented pie model or island-in-the-sea model.

In an embodiment, the fibers of each of the nonwoven layers of fibers of the secondary carpet backing are bicomponent fibers of the concentric core/sheath model, wherein the fibers are made of the same class of thermoplastic polymeric material or chemically different thermoplastic polymeric material.

Within the scope of this application, the same class of thermoplastic material means that same monomeric units of the polymer can be used, but the thermoplastic polymeric material can be different by a different polymer chain length, by a different density of the thermoplastic polymeric material or by a different orientation of the monomeric units, which can be isotactic, syndiotactic or atactic.

The core of the bicomponent fiber can comprise a thermoplastic polymeric material, which has a higher melting temperature as the thermoplastic polymeric material of the sheath. In an embodiment, the melting temperature of the thermoplastic polymeric material of the core and the thermoplastic polymeric material of the sheath differs by at least 10° C. In an embodiment, the melting temperature of the thermoplastic polymeric material of the core and the thermoplastic polymeric material of the sheath differs by at least 20° C. In an embodiment, the melting temperature of the thermoplastic polymeric material of the core and the thermoplastic polymeric material of the sheath differs by at least 30° C. In an embodiment, the melting temperature of the thermoplastic polymeric material of the core and the thermoplastic polymeric material of the sheath differs by at least 50° C. The melting temperature of a thermoplastic polymeric material is determined by Differential Scanning calorimetry (DSC) according to ISO 11357-3.

In an embodiment, the primary carpet backing comprises a structure of at least three layers, wherein a first layer and a third layer comprise a nonwoven layer of fibers, and wherein a second layer comprises a reinforcement layer of fibers and is located between the first and the third layer, wherein the nonwoven layer of fibers of the first layer has an air permeability of at most 8000l/m$^2$·s, and the nonwoven layer of fibers of the third layer has an air permeability of at least 3500l/m$^2$·s measured according to ISO 9237:1995, wherein the nonwoven layer of fibers of the first layer has a lower air permeability than the nonwoven layer of fibers of the third layer. Further, the feature that the nonwoven layer of fibers of the first layer has a lower air permeability than the nonwoven layer of fibers of the third layer is also called the "asymmetry of air permeability of the primary carpet backing" for reasons of readability and conciseness.

The thermoplastic polymeric material of the fibers of the nonwoven layers of fibers of the first layer and/or the fibers of the nonwoven layer fibers of the third layer can be selected from a group comprising polyolefins such as polyethylene (PE) and polypropylene (PP), polyesters such as polyethylene terephthalate (PET), polytrimethylene terephthalate (PTT), polybutylene terephthalate (PBT), polyethylene naphthalate (PEN) polyetylene-1,2-furandicaboxylate (PEF), poly lactic acid (PLA), polyamides such as polyamide 6,6 (PA6,6) and polyamide 6 (PA6), and copolymers or blends thereof.

In an embodiment, the primary backing comprised in the tufted carpet comprises at least a first layer comprising a nonwoven layer of fibers composed of thermoplastic polymeric material and having an air permeability of at most 8000 l/m$^2$·s, measured according to ISO 9237:1995.

The fact that the primary carpet backing comprises a reinforcement layer of fibers improves the flatness stability perpendicular to the plane of a carpet tile (z-dimension), like dishing or doming of the carpet tile. The fact that the primary carpet backing comprises a third layer comprising a nonwoven layer of fibers having a minimum air permeability improves penetration of the precoat applied to the tufted primary carpet backing, while the first layer comprising a nonwoven layer of fibers having a reduced air permeability prevents latex bleeding of the precoat to the face of the carpet tile.

In an embodiment the asymmetry of air permeability of the primary carpet backing is induced by the weight ratio of the nonwoven layer of fibers of the first layer and the third layer, wherein it is desirable that the nonwoven layer of fibers of the first layer has a higher weight than the nonwoven layer of fibers of the third layer.

Preferably, the first layer of the primary carpet backing is located at the carpet face of the tufted carpet and the second layer and the third layer are subsequently, behind the first layer.

The weight ratio of the first layer and the third layer can be at least 70:30, more preferably at least 80:20, even more preferably at least 90:10.

Due to the higher amount of weight of the nonwoven layer of fibers of the first layer of the primary carpet backing, an increased surface coverage of the nonwoven layer of fibers of the first layer of the primary backing can be provided.

In an embodiment, the first layer comprising a nonwoven layer of fibers has a surface coverage between 1% and 40%. In an embodiment, the first layer comprising a nonwoven layer of fibers has a surface coverage between 2% and 30%. In an embodiment, the first layer comprising a nonwoven layer of fibers has a surface between 3% and 25%. In an embodiment, the first layer comprising a nonwoven layer of fibers has a surface between 5% and 20%. The surface coverage A is calculated in the following manner:

$$A = x * d;$$

with x being the number of filaments per filament layer and d being the diameter of the filaments. The number of filaments per layer x is calculated in the following manner:

$$x = \frac{N}{L};$$

wherein N is the number of layers of filaments and L is the total length of filaments per area unit. The quantities N and L are calculated in the following manner:

$$N = \frac{T}{d};$$

wherein d is the thickness of the filament in case monofilaments are used and wherein d is the thickness of the filament core in case bicomponent filaments are used.

$$L = M * t;$$

wherein T is the thickness of the first layer of fibers, M is the area weight of the first layer of fibers and t is the linear density of the filaments. The thickness T is determined in accordance with DIN ISO 9073-2 with a pressure foot of 25 $cm^2$ and a pressure of 0.05 kPa.

Due to the lower weight of the third layer a reduced surface coverage of the nonwoven layer of fibers of the third layers of the primary carpet backing can be provided.

In an embodiment, the third layer comprising a nonwoven layer of fibers has a surface coverage between 1% and 40%. In an embodiment, the third layer comprising a nonwoven layer of fibers has a surface coverage between 2% and 30%. In an embodiment, the third layer comprising a nonwoven layer of fibers has a surface between 3% and 25%. In an embodiment, the third layer comprising a nonwoven layer of fibers has a surface between 5% and 20%.

Without being bound to theory, an increased surface coverage of the nonwoven layer of fibers of the first layer can lead to a lower air permeability, a lower permeability for fluids e.g. polymer coating and/or precoating can be provided. Due to the lower air permeability of the first layer of the primary carpet backing, the optional precoat and/or polymer coat is disabled to go through the first layer of the primary carpet backing, thus, latex bleeding is disabled.

A reduced surface coverage of the fibers of the nonwoven layer of fibers of the third layer of the primary carpet backing can lead to a higher air permeability, a higher permeability for fluids e.g. polymer coating and/or precoating. Due to the higher air permeability, the optional precoat and/or polymer coat is enabled to go through the third layer onto and/or into the second layer of the primary carpet backing, thus, forces in x- and/or in y-direction can be transmitted to the reinforcement layer of the second layer of the primary carpet backing.

In a preferred embodiment, the first layer of the primary carpet backing comprises a lower air permeability than the third layer of the primary carpet backing.

Without being bound to theory, it is believed that the combination of the first layer, comprising a lower air permeability than the third layer can lead to the disability of latex bleeding and the transmitting of forces in x- and/or y-direction to the reinforcement layer of the second layer of the primary carpet backing.

The asymmetry of air permeability of the primary carpet backing can also be introduced by a different average diameter of the fibers comprised in the nonwoven layer of fibers of the first layer and also in the third layer of the primary carpet backing.

The nonwoven layer of fibers of the first layer and/or the nonwoven layer of fibers of the third layer of the primary carpet backing can comprise mono-component fibers, two types of mono-component fibers and/or bicomponent fibers.

Thereby, the nonwoven layer of fibers of the first layer and/or the nonwoven layer of fibers of the third layer of the primary carpet backing can be made by any suitable process, such as a spun-laid process, air-laid process, wet-laid process, melt-blown process, or a carding process.

In an embodiment, the nonwoven layer of fibers of the first layer and/or the nonwoven layer of fibers of the third layer are made by a spun-laid process, wherein the fibers are made from a thermoplastic polymeric material. In the spun-laid process, bonding of the fibers of the nonwoven layer of fibers of the first layer and/or of the nonwoven layer of fibers of the third layer can be conducted by calendaring, hydro entanglement, needling, ultra sonic bonding, chemical bonding, and other thermal bonding methods e.g. hot air bonding.

In an embodiment, the nonwoven layer of fibers of the first layer and/or the nonwoven layer of fibers of the third layer of the primary carpet backing comprises two types of mono component fibers, which comprise two chemically different thermoplastic polymeric materials, wherein two types of mono-component fibers differ in melting temperature by at least of 10° C. In an embodiment, the two types of mono-component fibers differ by at least 20° C. In an embodiment, the two types of mono-component fibers differ by at least 30° C. In an embodiment, the two types of mono-component fibers differ by at least 50° C. The melting temperature of a thermoplastic polymeric material is determined by Differential Scanning calorimetry (DSC) according to ISO 11357-3.

In an embodiment, the fibers of the nonwoven layers of fibers of the first layer and/or the fibers of the nonwoven layer fibers of the third layer of the primary carpet backing are bicomponent fibers of the concentric or eccentric core/sheath model, side-by-side model, segmented pie or island-in-the-sea model.

In an embodiment, the fibers of the nonwoven layer of fibers of the first layer and/or the fibers of the nonwoven layer fibers of the third layer of the primary carpet backing are bicomponent fibers of the concentric core/sheath model, wherein the fibers are made of the same class of thermoplastic polymeric material or chemically different thermoplastic polymeric material.

In an embodiment, the fibers of the nonwoven layer of fibers of the first layer of the primary carpet backing have an average diameter of at most 50 μm. In an embodiment, the fibers of the nonwoven layer of fibers of the first layer of the primary carpet backing have an average diameter of at most 40 μm. In an embodiment, the fibers of the nonwoven layer of fibers of the first layer of the primary carpet backing have an average diameter of at most 30 μm. In an embodiment, the fibers of the nonwoven layer of fibers of the first layer of the primary carpet backing have an average diameter of at most 25 μm. In an embodiment, the fibers of the nonwoven layer of fibers of the first layer of the primary carpet backing have an average diameter of at most 20 μm. The average diameter of the fibers being measured by microscopy as average over 10 samples.

In an embodiment, the fibers of the nonwoven layer of fibers of the third layer of the primary carpet backing have an average diameter of at least 30 μm. In an embodiment, the fibers of the nonwoven layer of fibers of the third layer of the primary carpet backing have an average diameter of at least 35 μm. In an embodiment, the fibers of the nonwoven layer of fibers of the third layer of the primary carpet backing have an average diameter of at least 40 μm. In an embodiment, the fibers of the nonwoven layer of fibers of the third layer of the primary carpet backing have an average diameter of at least 50 μm. In an embodiment, the fibers of the nonwoven layer of fibers of the third layer of the primary carpet backing have an average diameter of at least 60 μm. The average diameter of the fibers being measured by microscopy as average over 10 samples.

Without being bound to theory, it is believed that due to the lower average diameter of the fibers of the nonwoven layer of fibers of the first layer of the primary carpet backing and the higher average diameter of the fibers of the nonwoven layer of fibers of the third layer of the primary carpet backing, differences in surface coverage the nonwoven layer of fibers can be provided.

At a constant weight of a layer, e.g. in the nonwoven layer of fibers of the first layer of the primary carpet backing, and a lower average diameter of the fibers of the nonwoven layer of fibers of the first layer of the primary carpet backing, the value of length of fibers per square meter ($m/m^2$) of the nonwoven layer of fibers of the first layer is increased which can lead to an increased surface coverage of the nonwoven layer of fibers of the first layer.

By having the opposite case, also at a constant weight of a layer, e.g. in the nonwoven layer of fibers of the third layer of the primary carpet backing, and a higher average diameter of the fibers of the nonwoven layer of fibers of the third layer, value of length of fibers per square meter ($m/m^2$) of the nonwoven layer of fibers of the third layer will be decreased, which can lead to a reduced surface coverage of the nonwoven layer of fibers of the third layer.

Accordingly, without being bound to theory it is believed that by combining a higher weight of a layer of fibers and a lower average diameter of the fibers of a layer, in particular in the nonwoven layer of fibers of the first layer of the primary carpet backing, can be synergistically support the effect of a lower air permeability and inherently a lower permeability for fluids e.g. polymer coating and/or precoating.

By combining a lower amount of weight of a layer of fibers and a higher average diameter of the fibers of a layer, in particular of the nonwoven layer of fibers of the third layer of the primary carpet backing, can synergistically support the effect of a higher air permeability and a higher permeability for fluids e.g. polymer coating and/or precoating.

The tufted carpet according to the application can be manufactured by tufting a primary carpet backing with pile yarns, wherein the primary carpet backing can be a nonwoven layer of fibers or a composite, supplying a secondary carpet backing adjoining to the tufted primary backing, on the side of the primary carpet backing which exhibits backstitches, and supplying optionally a precoat coating and/or a polymer coating.

In an embodiment, supplying of the optional precoat coating and/or polymer coating is performed by squeezing the precoat and/or polymer coat through the secondary carpet backing into the primary carpet backing.

In an embodiment, the primary carpet backing comprises at least two layers, wherein the at least two layers are tufted as individual layers adjoining each other at their main surfaces or the at least two layers are tufted as a composite.

In an embodiment, the at least two layers of the primary carpet backing are tufted as a composite.

The invention claimed is:

1. A tufted carpet comprising a tufted primary carpet backing, pile yarns tufted into the primary carpet backing, and a secondary carpet backing adjoining to the primary carpet backing on the side of the primary carpet backing which exhibits backstitches and a precoat and/or a polymer coat, wherein the secondary carpet backing comprises at least a reinforcement layer of fibers, with a tensile modulus of at least 25 GPa, of glass, carbon, basalt, stone wool, high modulus low shrinkage (HMLS) polyester, mineral material, aramid or ultra high molecular weight polyethylene that provide stability of the secondary carpet backing against elongation, the secondary carpet backing is impregnated by the precoat and/or the polymer coat, the secondary backing comprises two nonwoven layers of fibers, and the reinforcement layer is between the two nonwoven layers of fibers.

2. The tufted carpet according to claim 1, wherein the secondary carpet backing comprises less than 3 volume % of negligible voids.

3. The tufted carpet according to claim 1, wherein the reinforcement layer is a scrim or an unidirectional layer of fibers, wherein the fibers of the unidirectional layer of fibers are aligned substantially parallel oriented in machine direction and are spaced apart from each other.

4. The tufted carpet according to claim 1, wherein each of the nonwoven layers of fibers in the secondary backing has an average weight of at most 50 $g/m^2$.

5. The tufted carpet according to claim 1, wherein the fibers of the nonwoven layers of fibers in the secondary backing have an average diameter of at least 30 μm.

6. The tufted carpet according to claim 1, wherein the nonwoven layers of fibers in the secondary backing comprise mono component fibers, two types of mono-component fibers and/or bicomponent fibers.

7. The tufted carpet according to claim 1, wherein the fibers of the nonwoven layers of fibers in the secondary backing comprise a thermoplastic polymeric material selected from a group comprising polyolefins, polyesters, polyamides, and copolymers or blends thereof.

8. The tufted carpet according to claim 1, wherein the primary carpet backing comprises at least a first layer comprising a nonwoven layer of fibers composed of thermoplastic polymeric material and having an air permeability of at most 8000 $l/m^2 \cdot s$, measured according to ISO 9237:1995.

9. The tufted carpet according to claim 1, wherein the primary carpet backing comprises an asymmetric structure of at least three layers, a first layer and a third layer comprises a nonwoven layer of fibers, a second layer comprises a reinforcement layer of fibers and is between the first and the third layer, the first layer of the primary carpet backing is closest to the tufted pile yarns and the second layer and the third layer are located subsequently behind the first layer, the nonwoven layer of fibers of the first layer has an air permeability of at most 8000 $l/m^2 \cdot s$, and the nonwoven layer of fibers of the third layer has an air permeability of at least 3500 $l/m^2 \cdot s$ measured according to ISO 9237:1995, and the nonwoven layer of fibers of the first layer has a lower air permeability as the nonwoven layer of fibers of the third layer.

10. The tufted carpet according to claim 9, wherein the fibers of the nonwoven layer of fibers of the first layer of the primary carpet backing have an average diameter of at most 50 μm and the fibers of the nonwoven layer of fibers of the third layer of the primary carpet backing have an average diameter of at least 30 mm.

11. A process of producing the tufted carpet according to claim 1 comprising:

generating the tufted primary carpet backing by tufting a primary carpet backing with pile yarns, wherein the primary carpet backing comprises a nonwoven layer of fibers or a composite, supplying the secondary carpet backing adjoining to the tufted primary backing, on the side of the tufted primary backing which exhibits backstitches, and supplying the precoat coating and/or a polymer coating.

12. The process according to claim 11, further comprising supplying the precoat coating and/or polymer coating by squeezing the precoat and/or polymer coat through the secondary carpet backing into the primary carpet backing.

13. The process according to claim 11, wherein the primary carpet backing comprises at least two layers, and the at least two layers are tufted as individual layers adjoining each other at their main surfaces.

14. The tufted carpet according to claim 1, wherein the reinforcement layer is a unidirectional layer of fibers, and the fibers of the unidirectional layer of fibers are aligned substantially parallel, oriented in a machine direction, and are spaced apart from each other.

* * * * *